United States Patent [19]

Stine et al.

[11] Patent Number: 5,039,398

[45] **Date of Patent: * Aug. 13, 1991**

[54] ELIMINATION OF CAUSTIC PREWASH IN THE FIXED BED SWEETENING OF HIGH NAPHTHENIC ACIDS HYDROCARBONS

[75] Inventors: Laurence O. Stine, Western Springs; Jeffery C. Bricker, Buffalo Grove; Gregory J. Thompson, Waukegan; Thomas A. Verachtert, Wheeling, all of Ill.

[73] Assignee: UOP, Des Plaines, Ill.

[ * ] Notice: The portion of the term of this patent subsequent to Jun. 19, 2007 has been disclaimed.

[21] Appl. No.: 495,245

[22] Filed: Mar. 19, 1990

[51] Int. Cl.[5] ..... C10G 27/10

[52] U.S. Cl. ..... 208/192; 208/189; 208/203; 208/263

[58] Field of Search ..... 208/189, 192, 203, 263

[56] References Cited

U.S. PATENT DOCUMENTS

| | | | |
|---|---|---|---|
| 2,337,467 | 12/1943 | Hewlett | 208/263 |
| 2,850,435 | 9/1958 | Fierce et al. | 208/263 |
| 2,918,426 | 12/1959 | Quiquerez et al. | 208/206 |
| 2,966,453 | 12/1960 | Gleim et al. | 208/206 |
| 2,999,806 | 9/1961 | Thompson | 208/189 |
| 3,108,081 | 10/1963 | Gleim et al. | 252/428 |
| 3,176,041 | 3/1965 | Ayers | 208/263 |
| 3,252,892 | 5/1966 | Gleim et al. | 208/206 |
| 3,980,582 | 9/1976 | Anderson et al. | 252/428 |
| 4,156,641 | 5/1979 | Frame | 208/207 |
| 4,157,312 | 6/1979 | Frame | 252/428 |
| 4,207,173 | 6/1980 | Stanski, Jr. | 208/207 |
| 4,290,913 | 9/1981 | Frame | 252/428 |
| 4,337,147 | 6/1982 | Frame | 208/206 |
| 4,490,246 | 12/1984 | Verachtert | 208/206 |
| 4,502,949 | 3/1985 | Frame et al. | 208/189 |
| 4,634,519 | 1/1987 | Danzik | 208/263 |
| 4,753,722 | 6/1988 | Humble et al. | 208/207 |
| 4,908,122 | 3/1990 | Frame et al. | 208/189 |
| 4,909,925 | 3/1990 | Hodgson et al. | 208/207 |
| 4,913,802 | 4/1990 | Bricker et al. | 208/189 |
| 4,923,596 | 5/1990 | Bricker et al. | 208/207 |

OTHER PUBLICATIONS

J. R. Salazar in "Handbook of Petroleum Refining Processes", R. A. Meyers, editor, pp. 9-3 to 9-13.

Kirk Othmer, "Encyclopedia of Science and Technology", 3rd Edition (1981), pp. 749-753.

*Primary Examiner*—Helane E. Myers

*Attorney, Agent, or Firm*—Thomas K. McBride; Eugene I. Snyder

[57] ABSTRACT

Although high naphthenic acid hydrocarbon feedstocks normally need to be washed with caustic prior to being sweetened in a fixed bed mercaptan-to-disulfide oxidation process to avoid bed plugging, the prewash can be eliminated if aqueous ammonia is used concurrent with and as a part of the sweetening process. Aqueous ammonia injected into a sour hydrocarbon stream prior to the sweetening zone not only eliminates bed plugging, but affords an aqueous phase from which naphthenic acids may be recovered easily and economically. The ammonia also can be recovered for reuse, affording a process with considerably enhanced economic return.

17 Claims, 1 Drawing Sheet

Figure 1:
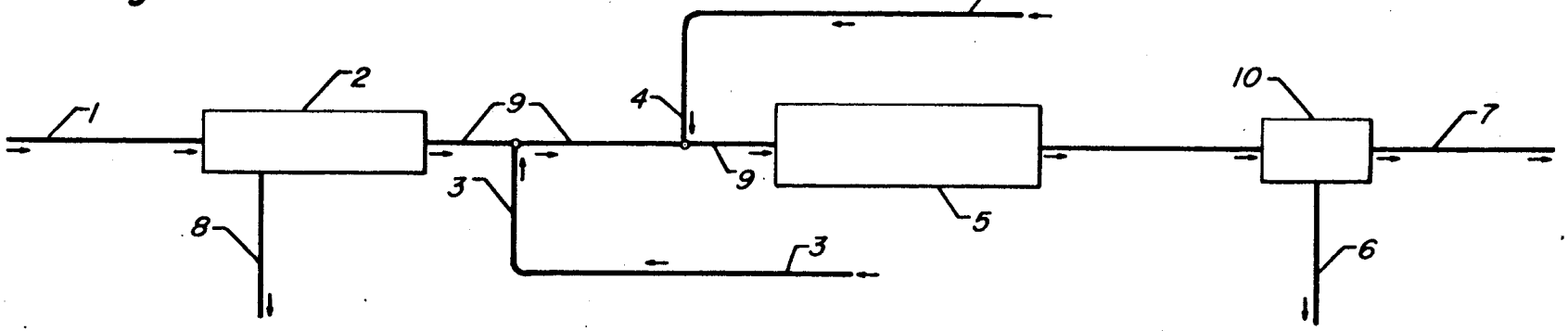

ELIMINATION OF CAUSTIC PREWASH IN THE FIXED BED SWEETENING OF HIGH NAPHTHENIC ACIDS HYDROCARBONS

BACKGROUND OF THE INVENTION

This invention relates to the elimination of a caustic prewash in the fixed bed sweetening of hydrocarbon feedstocks containing a high level of naphthenic acids and to the recovery of the naphthenic acids. More particularly, it relates to the use of aqueous ammonia as an adjunct to fixed bed sweetening in a process where not only the caustic prewash can be eliminated, but the naphthenic acids can be recovered and the ammonia values also can be recovered and reused. Because of the rather particularized nature of our invention, it appears desirable to expound on certain current process characteristics so that the contributions of the present invention in advancing the relevant art can be better appreciated.

Many hydrocarbon streams have sulfur-containing compounds as undesirable components whose removal constitutes an important stage of hydrocarbon processing. Where these components are mercaptans their "removal" is generally only a conversion of mercaptans to disulfides which remain in the feedstock as inoffensive components of the hydrocarbon stream, a process usually referred to as "sweetening" (with the initial mercaptan-laden stream referred to as "sour" feedstock). The conversion of mercaptans to disulfides often is accomplished merely through air oxidation as catalyzed by various metal chelates; see J. R. Salazar in "Handbook of Petroleum Refining Processes", R. A. Meyers, editor, pages 9-3 to 9-13. But catalysis of mercaptan oxidation proceeds best in an alkaline environment—and therein hangs our tale.

The prior art has required a highly alkaline environment, typically achieved by strong bases such as alkali metal hydroxides (for example, caustic soda). Unfortunately, the caustic does not merely provide an alkaline environment but in time is neutralized by acidic components of the hydrocarbon stream, requiring its continued replacement and replenishment. Disposal of spent caustic solutions is itself an environment problem, and proper disposal may exact a heavy financial penalty on the sweetening process. This is especially true for certain feedstocks, such as kerosine, which typically have a significant content of naphthenic acids.

Naphthenic acids are carboxylic acids found in petroleum and various petroleum fractions during their refining; see Kirk Othmer, "Encyclopedia of Science and Technology", 3rd Edition (1981), pp 749-53. Naphthenic acids are predominantly monocarboxylic acids having one or more cycloaliphatic groups alkylated in various positions with short chain aliphatic groups and containing a polyalkylene chain terminating in the carboxylic acid function. Although cyclopentane rings are the predominant cycloaliphatic ring structure, other cycloaliphatics rings, such as cyclohexanes, also may be present in appreciable quantities. The predominant acids are represented in Kirk Othmer by the formula,

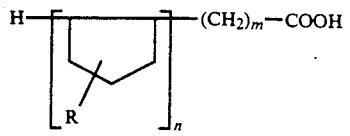

where n may range from 1 to 5, m is greater than 1, and R is a small aliphatic group, predominantly a methyl group. Since naphthenic acids are well known in the art their further characterization is unnecessary and the interested reader may consult appropriate texts for additional information.

The naphthenic acid content of feedstocks such as kerosine engenders further complications arising from the limited solubility of alkali metal naphthenates in concentrated alkali. One consequence is that when a caustic-wet fixed bed oxidation catalyst is used—a common and otherwise economically favored variant—formation of insoluble alkali metal naphthenates tends to cause bed plugging. To avoid this, kerosine and kerosine-like feedstocks undergo a caustic prewash to remove naphthenic acids prior to entry of the feedstock to the fixed bed. But the solubility characteristics of the alkali metal naphthenates are such that their efficient extraction from kerosine-type feedstocks into aqueous media requires utilization of a dilute caustic (usually under 3 weight percent) prewash, which increases the volume of the spent caustic and further intensifies its disposal problem.

Although naphthenic acids are troublesome in the sweetening process they do have significant value as precursors to wood preservatives, oil-based paint dryers, surfactants, corrosion inhibitors, and lubricant additives. Their recovery is highly desirable, but in the scenario described above they must be recovered from a dilute aqueous solution, which imposes yet another financial burden.

The dilemma faced by a processor with the need to sweeten the liquid hydrocarbon feedstocks, and especially kerosine-type feedstocks, is multifaceted. The most desirable sweetening process which converts mercaptans to disulfides operates best in an alkaline environment. The naphthenic acids in feedstocks previously have been removed in a caustic prewash to avoid reactor bed plugging, but the limited solubility of alkali metal naphthenates requires the use of dilute alkali, which exacerbates the disposal problem of spent caustic solutions. Although the naphthenic acids themselves are valuable commodities whose recovery might otherwise offset spent caustic disposal costs their recovery from dilute alkali is difficult and expensive, with little if any economic return. The result is that high naphthenic acids in a hydrocarbon feed complicate a simple chemical process with economic burdens.

The villains in this drama are not the naphthenic acids; basically these are quite desirable articles of commerce. Instead the villain is caustic. Heretofore this villain was perceived as omnipresent and unavoidable, truly a necessary evil. But our invention is but another example of the triumph of good over evil, for we have found a way which at once avoids the villain of caustic solutions while capturing the naphthenic acids in a gilded monetary net.

The keystone of our invention is the observation that if high naphthenic acid unsweetened hydrocarbon feedstocks are mixed with aqueous ammonia prior to entering a fixed bed oxidation catalyst effecting sweetening, there is no formation of insoluble naphthenate salts causing bed plugging. Evidently the solubility of ammonium naphthenates relative to alkali metal naphthenates is enough greater to obviate the problem of bed plugging. This property in itself permits one to eliminate a caustic prewash. In addition the aqueous phase can be separated from the hydrocarbon phase after the reaction zone and the ammonia either reused, in whole or in part, and naphthenic acids can be more readily recovered from the aqueous ammoniacal solution than from the dilute caustic resulting from a caustic prewash.

Although recovery of a component from a concentrated solution would be expected to be significantly easier than its recovery from dilute solutions, the recovery of naphthenic acids from ammoniacal solutions of their ammonium salts is expedited still further by the fact that heating the ammoniacal solution causes the decomposition of the soluble (or, perhaps more accurately, the colloidal dispersion of) ammonium naphthenates to insoluble naphthenic acids. Thus, heating the recovered aqueous phase precipitates naphthenic acids which can be readily recovered in a quite high yield simply by, for example, filtration or centrifugation. As a bonus ammonia also is separately recoverable for reuse. In some cases distillation of all, or most, of the water may be desirable for optimum recovery of the naphthenic acids and ammonia. The result is not only the elimination of the disposal problem attending a caustic prewash but virtually quantitative recovery of valuable naphthenic acids at little expense and at little additional cost, with the added bonus of ammonia reuse. In addition, the lower base strength of ammonia relative to caustic may lead to more selective removal of naphthenic acids relative to phenols, a rather desirable result. The overall economic benefits can not be underestimated.

SUMMARY OF THE INVENTION

In its broadest aspect the invention described within is a method of eliminating a caustic prewash in the fixed bed sweetening of high naphthenic acid hydrocarbons by the use of aqueous ammonia concurrent with and as part of the fixed bed sweetening process. An embodiment comprises adding to a unsweetened liquid hydrocarbon feedstock containing naphthenic acids at a level corresponding to an acid number of at least 0.003 a portion of aqueous ammonia prior to the unsweetened feedstock entering the fixed bed sweetening zone and recovering the aqueous phase from the sweetened hydrocarbon feedstock after the sweetening zone. In a more specific embodiment the liquid hydrocarbon feedstock is kerosine. In another specific embodiment the aqueous ammoniacal solution contains as little as 5 ppm ammonia and as much as 10 weight percent ammonia. In a still further embodiment a portion of the recovered aqueous ammonia may be recycled and reused with another portion of unsweetened feedstock.

DESCRIPTION OF THE INVENTION

The purpose of this invention is to eliminate a caustic prewash from the fixed bed sweetening of sour feedstocks containing naphthenic acids in an amount corresponding to an acid number of at least 0.003. An ancillary purpose is the efficient and economical removal of naphthenic acids from such liquid hydrocarbon feedstocks with their attendant recovery in relatively high yield.

The feedstocks which may be used in the practice of our invention are petroleum derived liquid hydrocarbon feedstocks containing naphthenic acids in a quantity corresponding to an acid number of 0.003. By acid number is meant the amount of potassium hydroxide in milligrams necessary to neutralize the acid in 1 gram of feedstock. A naphthenic acid content corresponding to an acid number of 0.003 is the maximum naphthenic acid content permissible to avoid bed plugging in a subsequent caustic-wet fixed bed sweetening process (vide supra) and is conveniently used to represent the least amount of naphthenic acid which a liquid hydrocarbon feedstock may contain in order to fruitfully practice this invention. In practice it is unlikely that feedstocks with an acid number as low as 0.003 would in fact require a caustic prewash, but we emphasize that our invention can be used with feedstocks having such a low acid number.

The feedstocks may contain naphthenic acids corresponding to an acid number as high as about 4. The highest acid content feedstocks are gas oils, which may possess an acid number in the range 0.03 to 4, although more typical values are in the range from 0.03 to 1.0 with the value highly dependent on the crude source. High naphthenic acid feedstocks may be represented more typically by kerosine, whose acid number typically is in the range between about 0.01 and 0.06. Examples of petroleum feedstocks which may be used in the practice of this invention include kerosine, middle distillates, light gas oil, heavy gas oil, jet fuel, diesel fuel, heavy naphtha, lube oil, stove oil, heating oil, and other petroleum fractions with an end point up to about 600° C. Kerosine is in some aspects the most important member of this group for the practice of our invention.

As was indicated earlier, the liquid hydrocarbon feedstocks of this invention are sour, requiring sweetening prior to their subsequent utilization, and often contain between 0.005 and 0.8 weight percent (measured as elemental sulfur) of sulfur-containing compounds and from about 10 through about 5000 ppm of mercaptans (measured as mercaptan), although usually mercaptan levels are over 100 ppm.

A sour liquid hydrocarbon fraction is often sweetened in the presence of an oxidizing agent with a catalytic composite which comprises a metal chelate dispersed on an adsorbent support. The adsorbent support which may be used in the practice of this invention can be any of the well known adsorbent materials generally utilized as a catalyst support or carrier material. Preferred adsorbent materials include the various charcoals produced by the destructive distillation of wood, peat, lignite, nutshells, bones, and other carbonaceous matter, and preferably such charcoals as have been heat-treated or chemically treated or both, to form a highly porous particle structure of increased adsorbent capacity, and generally defined as activated carbon or charcoal. Said adsorbent materials also include the naturally occurring clays and silicates, e.g., diatomaceous earth, fuller's earth, kieselguhr, attapulgus clay, feldspar, montmorillonite, halloysite, kaolin, and the like, and also the naturally occurring or synthetically prepared refractory inorganic oxides such as alumina, silica, zirconia, thoria, boria, etc., or combinations thereof like silica-alumina, silica-zirconia, alumina-zirconia, etc. Any particular solid adsorbent material is selected with regard to its stability under conditions of its intended use. For example, in the treatment of a sour petroleum distillate, the adsorbent support should be insoluble in, and otherwise inert to, the hydrocarbon fraction at the alkaline reaction conditions existing in the treating zone. Charcoal, and particularly activated charcoal, is preferred because of its capacity for metal chelates, and because of its stability under treating conditions.

Another necessary component of the catalytic composite used in this invention is a metal chelate which is dispersed on an adsorptive support. The metal chelate employed in the practice of this invention can be any of the various metal chelates known to the art as effective in catalyzing the oxidation of mercaptans contained in a sour petroleum distillate to disulfides. The metal chelates include the metal compounds of tetrapyridinoporphyrazine described in U.S. Pat. No. 3,980,582, e.g., cobalt tetrapyridinoporphyrazine; porphyrin and metaloporphyrin catalysts as described in U.S. Pat. No. 2,966,453, e.g., cobalt tetraphenylporphyrin sulfonate; corrinoid catalysts as described in U.S. Pat. No. 3,252,892, e.g., cobalt corrin sulfonate; chelate organometallic catalysts such as described in U.S. Pat. No. 2,918,426, e.g., the condensation product of an aminophenol and a metal of Group VIII; and the metal phthalocyanines as described in U.S. Pat. No. 4,290,913, etc. As stated in U.S. Pat. No. 4,290,913, metal phthalocyanines are a preferred class of metal chelates.

The metal phthalocyanines which can be employed to catalyze the oxidation of mercaptans generally include magnesium phthalocyanine, titanium phthalocyanine, hafnium phthalocyanine, vanadium phthalocyanine, tantalum phthalocyanine, molybdenum phthalocyanine, manganese phthalocyanine, iron phthalocyanine, cobalt phthalocyanine, platinum phthalocyanine, palladium phthalocyanine, copper phthalocyanine, silver phthalocyanine, zinc phthalocyanine, tin phthalocyanine, and the like. Cobalt phthalocyanine and vanadium phthalocyanine are particularly preferred. The ring substituted metal phthalocyanines are generally employed in preference to the unsubstituted metal phthalocyanine (see U.S. Pat. No. 4,290,913), with the sulfonated metal phthalocyanine being especially preferred, e.g., cobalt phthalocyanine monosulfate, cobalt phthalocyanine disulfonate, etc. The sulfonated derivatives may be prepared, for example, by reacting cobalt, vanadium or other metal phthalocyanine with fuming sulfuric acid. While the sulfonated derivatives are preferred, it is understood that other derivatives, particularly the carboxylated derivatives, may be employed. The carboxylated derivatives are readily prepared by the action of trichloroacetic acid on the metal phthalocyanine.

In a preferred embodiment the catalytic composite also contains one or more quaternary ammonium salts to increase catalyst activity, as is taught by U.S. Pat. No. 4,157,312, all of which is hereby incorporated by reference. See also U.S. Pat. Nos. 4,290,913 and 4,337,147 for the use of composites containing a metal chelate oxidation catalyst and a quaternary ammonium salt in the sweetening of sour hydrocarbon fractions.

The usual practice of catalytic treating of sour hydrocarbon fraction containing mercaptans involves the introduction of highly alkaline agents, usually sodium hydroxide, into the sour hydrocarbon fraction prior to or during the treating operation. See U.S. Pat. Nos. 3,108,081 and 4,156,641. The oxidizing agent is most often air admixed with the fraction to be treated, and the alkaline agent is most often an aqueous caustic solution charged continuously to the process or intermittently as required to maintain the catalyst in the caustic-wetted state. The metal chelate component and other optional components, if any, can be dispersed on the adsorbent support in any conventional or otherwise convenient manner. All components can be dispersed on the support simultaneously from a common aqueous or alcoholic solution and/or dispersion thereof or separately and in any desired sequence. The dispersion process can be effected utilizing conventional techniques whereby the support in the form of spheres, pills, pellets, granules or other particles of uniform or irregular size or shape, is soaked, suspended, dipped one or more times, or otherwise immersed in an aqueous or alcoholic solution and/or dispersion to disperse a given quantity of the metal chelate. In general, the amount of metal phthalocyanine which can be adsorbed on the solid adsorbent support and still form a stable catalytic composite is up to about 25 weight percent of the composite. A lesser amount in the range of from about 0.1 to about 10 weight percent of the composite generally forms a suitably active catalytic composite.

One preferred method of preparation involves the use of a steam-jacketed rotary dryer. The adsorbent support is immersed in the impregnating solution and/or dispersion containing the desired components contained in the dryer and the support is tumbled therein by the rotating motion of the dryer. Evaporation of the solution in contact with the tumbling support is expedited by applying steam to the dryer jacket. In any case, the resulting composite is allowed to dry under ambient temperature conditions, or dried at an elevated temperature in an oven, or in a flow of hot gases, or in any other suitable manner.

An alternative and convenient method for dispersing the metal chelate and other optional components, if any, on the solid adsorbent support comprises predisposing the support in a sour hydrocarbon fraction treating zone or chamber as a fixed bed and passing a metal chelate solution and/or dispersion through the bed in order to form the catalytic composite in situ. This method allows the solution and/or dispersion to be recycled one or more times to achieve a desired concentration of the metal chelate on the adsorbent support. In still another alternative method, the adsorbent may be predisposed in said treating zone or chamber, and the zone or chamber thereafter filled with the solution and/or dispersion to soak the support for a predetermined period.

Typically, the sour hydrocarbon fraction is contacted with the catalytic composite which is in the form of a fixed bed. The contacting is thus carried out in a continuous manner. An oxidizing agent such as oxygen or air, with air being preferred, is contacted with the fraction and the catalytic composite to provide at least the stoichiometric amount of oxygen required to oxidize the mercaptan content of the fraction to disulfides.

The treating conditions which may be used to carry out the present invention are those that have been disclosed in the prior art. The process is usually effected at ambient temperature conditions (i.e., 15°-25° C.), although higher temperatures up to about 105° C. are suitably employed. Pressures of up to about 1,000 psi or more are operable although atmospheric or substantially atmospheric pressures are suitable. Contact times equivalent to a liquid hourly space velocity of from about 0.5 to about 10 or more are effective to achieve a desired reduction in the mercaptan content of a sour petroleum distillate, an optimum contact time being dependent on the size of the treating zone, the quantity of catalyst contained therein, and the character of the fraction being treated.

As previously stated, sweetening of the sour hydrocarbon fraction is effected by oxidizing the mercaptans to disulfides. Accordingly, the process is effected in the presence of an oxidizing agent, preferably air, although oxygen or other oxygen-containing gases may be employed. In fixed bed treating operations, the sour hydrocarbon fraction may be passed upwardly or downwardly through the catalytic composite. The sour hydrocarbon fraction may contain sufficient entrained air, but generally added air is admixed with the fraction and charged to the treating zone concurrently therewith. In some cases, it may be advantageous to charge the air separately to the treating zone and countercurrent to the fraction separately charged thereto. Examples of specific arrangements to carry out the treating process may be found in U.S. Pat. Nos. 4,490,246 and 4,753,722 which are incorporated by reference.

Whereas in the prior art feedstocks with a high naphthenic acid needed to have a caustic prewash prior to sweetening, for reasons previously elaborated upon, such a caustic prewash is eliminated by the practice of this invention. Instead the unsweetened hydrocarbon feedstock with a high acid number is mixed with aqueous ammonia prior to the feedstock entering the fixed bed treating zone. The aqueous ammoniacal solution mixed with the sour liquid hydrocarbon may contain ammonia at a concentration as low as about 5 ppm and up to about 10 weight percent ammonia. Emulsification arising from the soap-like properties of ammonium naphthenates tends to become a problem where ammonia is present in a concentration greater than 10 weight percent, which is the reason for the stated upper limit of ammonia concentration to be used in the practice of this invention. As a practical matter solutions containing from about 0.1 through about 7 weight percent ammonia are the more usual ones, especially those in the range from 1 to 5 weight percent. However, it needs to be understood that the concentrations of the aqueous ammonaical solution are not at all limiting or critical in the practice of this invention.

We have observed that extraction of the naphthenic acids is efficient even with less than a stoichiometric quantity of ammonia, for reasons that are not presently understood, although it is more common to use at least an equivalent of ammoniacal solution. In practice a large excess of ammonia, based on the amount of naphthenic acids present, is used simply because the ammonia is recoverable and, as described within, usually is recovered and reused. Consequently, the amount of ammonia which is added to the naphthenic acid-containing sour feedstocks prior to the treating zone may be as much as about 1 weight percent based on total feedstock. It must be emphasized that these relatively large amounts are in no way deleterious to the practice of this invention. It also needs to be understood that the exact amount of ammonia used relative to naphthenic acids present is largely a matter of choice rather than being dictated by any limiting characteristics of the invention itself.

The hydrocarbon stream exiting the sweetening or treating zone is a sweetened hydrocarbon stream, as was described earlier, and the ammoniacal aqueous phase is separated from the hydrocarbon phase. At this stage of our process there are three discrete branches our invention may take, depending upon what percentage of the ammoniacal solution is returned to a sour stream prior to the treating zone. This percentage may vary from 0%—i.e., none of the recovered aqueous ammonia is recycled—to 100%—i.e., all of the aqueous ammonia is recycled.

The case where none of the aqueous ammonia is recycled to the sour hydrocarbon stream is analogous to the present situation where the caustic prewash is merely a waste stream to be disposed of. In this variant our invention does not afford advantages attending substantial elimination of the alkaline waste stream, as do the other variants of our invention, but nonetheless affords elimination of the separate process pre-wash step and also affords a waste stream from which naphthenic acids are more readily recoverable than is the case from the comparable dilute caustic solution.

In another variant a portion of the aqueous ammonia extract is recycled to fresh sour hydrocarbon, in many cases along with a fresh ammonia solution. Usually sufficient excess of ammonia is added to the sour hydrocarbon that it is only partially neutralized by the naphthenic acid. Consequently the aqueous phase in the post-treating zone remains alkaline and, even though it has dissolved ammonium naphthenates, it retains the capacity to neutralize and dissolve additional naphthenic acids. Consequently its reuse via recycling is an efficient use of ammonia. Although it may be unlikely that all of the post-treating zone ammonia will be recycled in a continuous process, nonetheless this is possible periodically, especially where ammonia recovery is practiced cyclically.

At some point the aqueous ammonia extract becomes so laden with ammonium naphthenates, or so little ammonia becomes available for further neutralization, that the spent aqueous extract containing the ammonium naphthenates is recovered. A surprisingly simple and efficient way of recovering the naphthenic acids from the aqueous solution of ammonium naphthenates is to simply heat the latter. By distillation any excess ammonia may be recovered and the ammonium naphthenates are thermally decomposed to afford the water-insoluble naphthenic acids plus additional ammonia which is also recovered. The water insoluble naphthenic acids are then simply collected, as by filtration or centrifugation, and the recovered ammonia is recycled to the wash stage.

The aqueous solution of ammonium naphthenates also may be treated so as to convert them to insoluble derivatives of naphthenic acids, such as their copper salts. This can be done simply by adding a solution of an uncomplexed Cu(II) salt to the aqueous solution of ammonium naphthenate. Such treatment leads to the almost immediate formation of water insoluble copper naphthenates.

Figure 2:
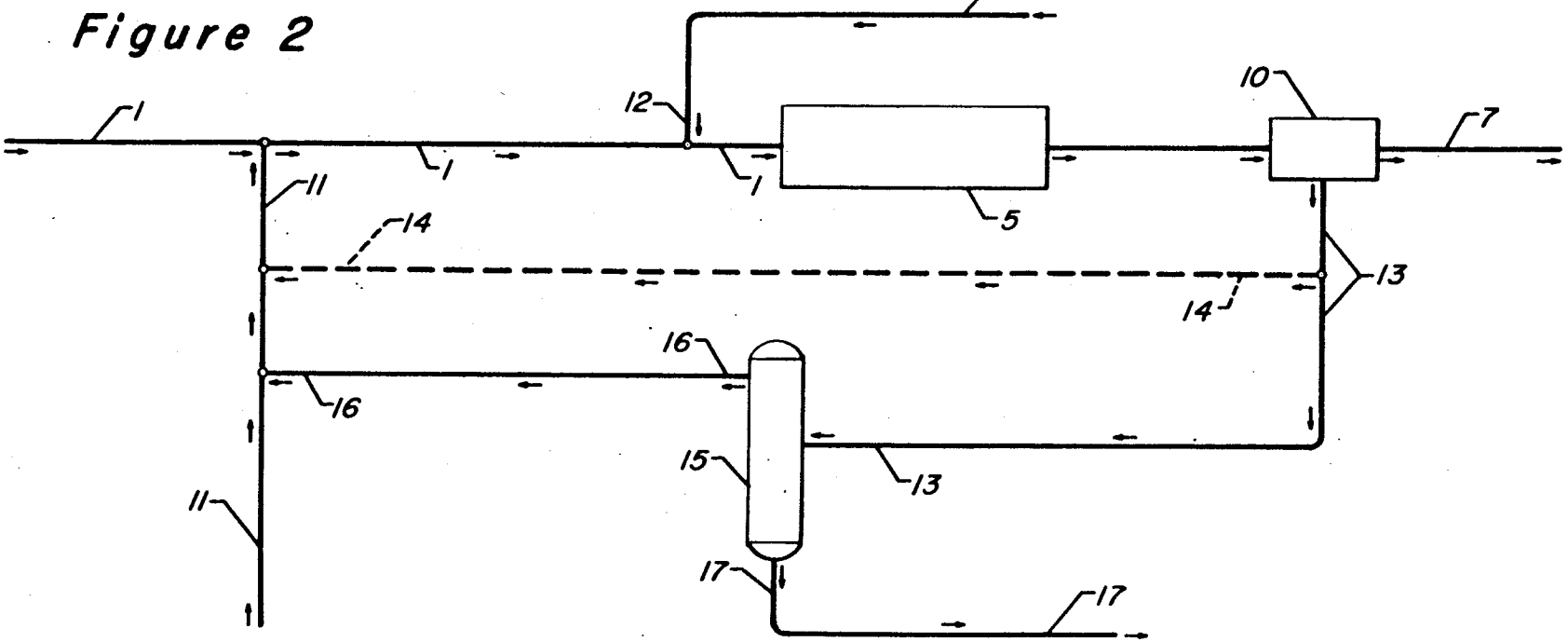

Our invention may also be understood with the aid of the process flow diagram of FIGS. 1 and 2, which provides a ready comparison of the prior art process with that of our invention.

Turning to the prior art process as represented in FIG. 1, a sour hydrocarbon stream, 1, containing high naphthenic acids, is first washed with caustic in the caustic pre-wash section 2, affording a caustic waste stream 8. Additional caustic is added at 3 to the washed but still sour hydrocarbon stream, 9, and air, as representative of the oxidizing agent, is added at 4 prior to the sweetener treating zone, 5, where mercaptans are converted to disulfides. After the treating zone in a separator zone, 10, the aqueous caustic phase, 6, is separated from the sweetened hydrocarbon fraction, 7, which undergoes post treatment.

Contrastingly, in our invention as shown in FIG. 2 the sour hydrocarbon stream, 1, does not undergo any pre-wash. Instead aqueous ammonia is added at 11 and air, as representative of the oxidizing agent, is added at 12 prior to the sweetener treating zone 5. The sweetened effluent from the treating zone is passed to a first separator zone, 10, to give a sweetened hydrocarbon stream 7 and an aqueous ammoniacal extract stream 13.

The aqueous ammoniacal extract is passed into a second separator zone, 15, although in a somewhat less preferable alternative all, or a portion of, the aqueous ammoniacal extract may be returned upstream to fresh sour hydrocarbon feed as indicated by the dotted line 14, with the remainder passing into the second separator zone 15. In the second separator zone ammonia is separated from the naphthenic acids, with the ammonia recycled to the sour stream at 11. Whether the ammonia is separated as gaseous ammonia or as aqueous ammonia is not particularly critical to the success of our invention and may be largely a matter of choice. A stripper is exemplary of the second separator zone. The ammonium naphthenates in the aqueous extract entering the second separator zone may be converted to naphthenic acids by heating the aqueous solution to decompose the ammonium salts while generating ammonia. Often such heating will be accompanied by substantial distillation of the water, but in any event the ammonia evolved will go overhead and be returned via line 16 at 11 to the sour hydrocarbon stream. Insoluble naphthenic acids will separate as bottoms and be removed and recovered at 17. Insoluble naphthenic acids also may be recovered in the second separator zone by their conversion to insoluble, uncomplexed Cu(II) salts, as described above. Whatever the details, the second separator zone serves to recover ammonia, which is recycled to the sour hydrocarbon stream, and naphthenic acids, either per se or as a water-insoluble derivative such as an uncomplexed Cu(II) salt.

The following examples are illustrative of our invention. Being only representative of the many variants which are possible, they are not to be looked upon as limiting our invention in any way.

EXAMPLE 1

A feedstock of kerosine of acid number 0.05 was passed over a fixed bed of a catalyst at a temperature of 38° C. and at 100 psig, with a liquid hourly space velocity of 0.5. The catalyst, generally described in U.S. Pat. No. 4,157,312, was a composite of cobalt phthalocyanine and a mixture of quaternary ammonium salts impregnated on a 10×30 mesh charcoal support and available as Merox TM 10 from UOP (Des Plaines, Ill.). Oxygen was provided as an oxidant at a level of twice the stoichiometric amount required for oxidation of mercaptan in the feed by injection of air into the unsweetened kerosine prior to its entering the fixed bed. A 4 weight percent aqueous ammonia solution was mixed with the unsweetened kerosine prior to the fixed bed in an amount sufficient to provide 800 ppm ammonia based on kerosine, which provided sufficient ammonia to give 53 equivalents ammonia per equivalent naphthenic acid. No bed plugging was noticed during 200 hours of continuous operation. At equilibrium the sweetened effluent had an acid number of 0.001–0.002.

EXAMPLE 2

This experiment shows the virtual quantitative recovery of both naphthenic acid and ammonia from an aqueous solution of ammonium naphthenate. To a refined sample of commercial naphthenic acid (39.05 gm) of acid number 247.07 was added 73.51 gm of dilute (1.65%) aqueous ammonia (1.20 gm of $NH_3$). The ratio of molar equivalents of ammonia to naphthenic acids was 0.41. This mixture was heated in a system containing a condenser leading to a reservoir with noncondensable vapors being passed through a mineral oil bubbler and a hydrochloric acid trap. The mixture was heated and when the temperature increased above 35° C. a basic gas could be detected at the condenser outlet with litmus paper. Distillation was continued for 4 hours at which time all of the water had been distilled. The flask residue of naphthenic acid weighed 39.38 gm. The mass balance of nitrogen in the condensate entraps accounted for 96% of the ammonia initially used. These results show that there is a high efficiency from neutralization of naphthenic acid with ammonia and that the resulting salts can be conveniently decomposed into ammonia and naphthenic acids virtually quantitatively.

EXAMPLE 3

To an aqueous solution of ammonium naphthenate was added 1 molar proportion of copper chloride. There was virtually immediate formation of a greenish oil which is the copper naphthenates. The oil may be separated from the aqueous phase and excess salts may be removed by suitable water wash. In this manner naphthenic acids may be readily recovered as their copper salts.

What is claimed is:

1. In the method of sweetening a mercaptan-containing hydrocarbon feedstock by the oxidation of mercaptans to disulfides catalyzed in a fixed bed treating zone by metal chelates in an alkaline environment, where the unsweetened hydrocarbon feedstock contains naphthenic acids in an amount corresponding to an acid number of at least 0.003 and has not undergone a caustic prewash, the improvement comprising mixing the unsweetened and unwashed hydrocarbon feedstock of said acid number with aqueous ammonia prior to said unsweetened feedstock entering the fixed bed treating zone, separating in the effluent from the treating zone the aqueous phase from the sweetened hydrocarbon phase, recovering the aqueous phase containing dissolved ammonium naphthenates, and returning a portion from 0 to 100% of the recovered aqueous phase to another portion of unsweetened hydrocarbon feedstock prior to its entering the fixed bed treating zone.

2. The method of claim 1 where the hydrocarbon feedstock is selected from the group consisting of kerosine, middle distillates, light gas oil, heavy gas oil, jet fuel, diesel fuel, heavy naphtha, lube oil, stove oil, heating oil, and other petroleum fractions having an end point up to about 600° C.

3. The method of claim 2 where the feedstock is kerosine.

4. The method of claim 1 where the aqueous ammonia solution contains from about 5 parts per million up to about 10 weight percent ammonia.

5. The method of claim 1 where the aqueous ammonia solution contains from about 0.1 to about 7 weight percent ammonia.

6. The method of claim 4 where the aqueous ammonia contains from about 1 up to about 5 weight percent ammonia.

7. The method of claim 1 where the ammonium naphthenates are converted to naphthenic acids by thermal decomposition of the ammonium naphthenates to ammonia and naphthenic acids.

8. The method of claim 1 where the ammonium naphthenates are converted to water-insoluble copper naphthenates.

9. A process for sweetening a mercaptan-containing hydrocarbon feedstock which has not undergone a caustic prewash and which has naphthenic acids in an amount corresponding to an acid number of at least 0.003 with recovery of the naphthenic acids therefrom comprising:

mixing the unsweetened and unwashed hydrocarbon feedstock with ammonia and an oxidizing agent prior to said unwashed feedstock entering a sweetening reactor zone;

passing said unwashed feedstock into the sweetening reactor zone, said zone containing a fixed bed of composite effective in oxidizing the mercaptans in said unwashed feedstock to disulfides, said unwashed feedstock contacting said composite at sweetening conditions whereby the feed is sweetened prior to its exiting said zone;

passing the sweetened effluent from the sweetening reactor zone having an aqueous ammoniacal extract phase containing dissolved naphthenic acids and a sweetened hydrocarbon phase to a first separator zone whereby the sweetened hydrocarbon and the aqueous ammoniacal extract phases are separated;

optionally recycling a portion of the separated aqueous ammoniacal extract to a fresh portion of unsweetened and unwashed hydrocarbon feedstock;

passing the remaining portion of the separated aqueous ammoniacal extract into a second separator zone wherein the ammonia is separated from the naphthenic acids dissolved therein;

recycling the ammonia from the second separator zone to a fresh portion of the unsweetened and unwashed hydrocarbon feed; and recovering the separated naphthenic acids as water-insoluble naphthenic acids or as water-insoluble derivatives of naphthenic acids.

10. The process of claim 9 where the hydrocarbon feedstock is selected from the group consisting of kerosine, middle distillates, light gas oil, heavy gas oil, jet fuel, diesel fuel, heavy naphtha, lube oil, stove oil, heating oil, and other petroleum fractions having an end point up to about 600° C.

11. The method of claim 10 where the feedstock is kerosine.

12. The process of claim 9 where the oxidizing agent is air.

13. The process of claim 9 where the ammonia is aqueous ammonia containing 5 parts per million to about 10 weight percent ammonia.

14. The process of claim 9 where the ammonia is aqueous ammonia containing from about 0.1 to about 7 weight percent ammonia.

15. The process of claim 9 where the ammonia is aqueous ammonia containing from about 1 to about 5 weight percent ammonia.

16. The process of claim 9 where the ammonia from the second separator zone is recycled to fresh unsweetened hydrocarbon feed as an aqueous solution.

17. The process of claim 9 where the second separator zone is a stripping tower.

* * * * *